US007849802B2

(12) United States Patent
Dalrymple

(10) Patent No.: US 7,849,802 B2
(45) Date of Patent: Dec. 14, 2010

(54) PROTECTIVE HOUSING ASSEMBLY FOR A TANK CAR MANWAY

(75) Inventor: Thomas H. Dalrymple, Desoto, TX (US)

(73) Assignee: Trinity Industries, Inc., Dallas, TX (US)

( * ) Notice: Subject to any disclaimer, the term of this patent is extended or adjusted under 35 U.S.C. 154(b) by 219 days.

(21) Appl. No.: 11/470,904

(22) Filed: Sep. 7, 2006

(65) Prior Publication Data

US 2007/0125259 A1 Jun. 7, 2007

Related U.S. Application Data

(63) Continuation-in-part of application No. 11/356,505, filed on Feb. 17, 2006.

(60) Provisional application No. 60/654,177, filed on Feb. 18, 2005.

(51) Int. Cl.
*B61D 5/00* (2006.01)

(52) U.S. Cl. ..... 105/358; 105/377.07

(58) Field of Classification Search ..... 105/358, 105/377.07; 296/100.05; 248/519; 52/20
See application file for complete search history.

(56) References Cited

U.S. PATENT DOCUMENTS

| | | | | | |
|---|---|---|---|---|---|
| 1,487,518 | A | * | 3/1924 | Nichols et al. | 220/314 |
| 1,605,416 | A | * | 11/1926 | Willoughby | 105/358 |
| 1,664,116 | A | * | 3/1928 | Kortenhoeven | 105/355 |
| RE19,537 | E | * | 4/1935 | Pierce | 220/562 |
| 2,102,124 | A | * | 12/1937 | Lithgow | 220/562 |
| 2,290,038 | A | * | 7/1942 | Folmsbee | 137/375 |
| 2,620,748 | A | * | 12/1952 | Shields | 410/68 |
| 3,142,410 | A | | 7/1964 | Arnold | 220/41 |
| 3,194,182 | A | * | 7/1965 | Flood | 105/358 |
| 3,528,375 | A | * | 9/1970 | Trausch | 105/358 |
| 3,561,636 | A | * | 2/1971 | Marxen et al. | 105/360 |
| 3,713,399 | A | * | 1/1973 | Bembridge et al. | 105/358 |
| 4,287,999 | A | | 9/1981 | Heisterberg | 220/222 |
| 4,371,090 | A | | 2/1983 | Ogarek et al. | 220/224 |
| 4,527,489 | A | * | 7/1985 | Schlink | 105/358 |
| 4,673,102 | A | | 6/1987 | Bullock, Jr. | 220/457 |
| 4,685,585 | A | * | 8/1987 | Robbins | 220/256.1 |
| 5,011,038 | A | | 4/1991 | Schultz | 220/320 |
| 5,056,680 | A | * | 10/1991 | Sharp | 220/567.1 |
| 5,467,719 | A | * | 11/1995 | Dalrymple et al. | 105/362 |
| 6,053,113 | A | | 4/2000 | Shaddle | 105/377.07 |
| 6,076,471 | A | * | 6/2000 | Burian et al. | 105/377.07 |
| 6,105,805 | A | | 8/2000 | Labelle et al. | 220/262 |
| 6,216,603 | B1 | | 4/2001 | Shaddle | 105/377.07 |
| 6,253,801 | B1 | | 7/2001 | Lie | 141/50 |
| 6,328,064 | B1 | | 12/2001 | Garfield | 137/590 |
| 6,390,119 | B1 | * | 5/2002 | Crochet et al. | 137/347 |
| 6,557,477 | B1 | * | 5/2003 | Degutis et al. | 105/358 |
| 6,910,427 | B2 | * | 6/2005 | Woodall et al. | 105/358 |

(Continued)

*Primary Examiner*—Joseph Morano
*Assistant Examiner*—Jason C Smith
(74) *Attorney, Agent, or Firm*—Baker Botts L.L.P.

(57) ABSTRACT

A railway tank car is provided having a manway formed in a body of the tank car. The tank car includes a manway cover plate coupled to the body of the tank car and disposed over at least a portion of the manway. A protective housing assembly is coupled to the body of the tank car and disposed around the manway cover plate. At least one structural support is coupled with an interior surface of the body of the tank car adjacent to the protective housing assembly.

11 Claims, 11 Drawing Sheets

U.S. PATENT DOCUMENTS

2002/0195019 A1* 12/2002 Woodall ..... 105/358
2003/0137163 A1* 7/2003 Hayashi et al. ..... 296/204
2003/0145527 A1* 8/2003 Meyers ..... 52/20
2004/0074416 A1* 4/2004 Woodall et al. ..... 105/358
2006/0185554 A1* 8/2006 Dalrymple et al. ..... 105/358
2007/0125259 A1* 6/2007 Dalrymple ..... 105/236
2007/0227077 A1* 10/2007 Cuny et al. ..... 52/20

* cited by examiner

PROTECTIVE HOUSING ASSEMBLY FOR A TANK CAR MANWAY

RELATED APPLICATION

This application is a Continuation-In-Part of U.S. patent application Ser. No. 11/356,505, filed Feb. 17, 2006, entitled Protective Housing Assembly for a Tank Car Manway, which claims the benefit of U.S. provisional application Ser. No. 60/654,177, filed Feb. 18, 2005, entitled System and Method for an Improved Protective Housing.

TECHNICAL FIELD

The present invention is related to tank cars and related components, and more particularly to a system and method for an improved protective housing assembly for a tank car manway.

BACKGROUND OF THE INVENTION

Tank cars have been used for many years to transport a wide variety of commodities including liquids, gasses and other fluids. The contents of a tank car may sometimes be potentially hazardous if appropriate safety precautions are not taken. Also, the contents of a tank car may be valuable and subject to theft or misappropriation.

Most tank cars are designed with an access opening or manway nozzle located in the upper portion of the associated tank, proximate a midpoint between opposite ends of the tank car. A manway cover plate is typically bolted or otherwise secured to the opening at the top of the nozzle to function as a liquid-tight closure and to allow only limited access by personnel to the interior of the tank. Various pipes, valves, fittings and other components are also often located in the vicinity of the manway to control adding and discharging lading from the tank car. The valves, fittings and other components are typically selected based on characteristics and properties of the commodity or lading being transported.

Valves, fittings and other components are often mounted on the manway cover plate of modern pressurized tank cars. Pressure car fittings typically include two "liquid or fluid" valves for loading and unloading of an associated commodity. Respective check valves and induction piping are also provided with respective loading and unloading valves. One or more vapor valves, gauging devices and safety relief valves may also be mounted on the manway cover. Some tank cars may have smaller valves for drawing samples of lading and thermal wells for measuring the temperature of the lading. Non-pressurized tank cars may also have similar valves and fittings mounted on a manway cover similar to a pressurized tank car.

Various types of protective housing assemblies or dome structures are often disposed on the upper portion of a tank car adjacent to the manway to protect associated piping, valves, fittings and other components. All pressurized tank cars are required to have such protective housing assemblies or dome structures covering any pipes, valves, fittings and other components located on an upper portion of the pressurized tank car. A relatively thick, steel ring or cylindrical portion is often attached by bolting to the cover plate to protect the valves, fittings, and other components in the event the tank car is derailed and overturns.

In the event of a high speed derailment, the forces acting on the overturned tank car may be sufficient to remove the protective housing assembly from the tank car and expose the enclosed valves, fittings, and other components to damaging impact forces. These impact forces may result in the shearing off or damage of exposed components. If a component is damaged or removed, the contents of the tank car may be released to the ambient environment causing a hazardous condition and/or loss of the contents of the tank car.

SUMMARY OF THE INVENTION

In accordance with teachings of the present invention, disadvantages and problems associated with tank car damage caused during derailments or other collisions have been substantially reduced. More specifically, a protective housing assembly for a tank car manway is provided.

In one embodiment of the present invention, a railway tank car is provided having a manway formed in a body of the tank car. The tank car includes a manway cover plate coupled to the body of the tank car and disposed over at least a portion of the manway. A protective housing assembly is coupled to the body of the tank car and disposed around the manway cover plate. At least one structural support is coupled with an interior surface of the body of the tank car adjacent to the protective housing assembly.

In another embodiment of the present invention, the structural support for the protective housing assembly includes two generally rectangular steel plates coupled with the inside of the tank car. The steel plates may be positioned such that the longitudinal axes of the two steel plates are parallel to the longitudinal axis of the body of the tank car.

In yet another embodiment of the present invention, structural support for the protective housing assembly may be provided by an annular ring support that is coupled to the inside of the tank car adjacent a cylindrical portion of the protective housing assembly. The annular ring support may be positioned such that a circular mid-line of the annular ring support may be aligned with a cylindrical portion of the protective housing assembly.

Technical advantages of particular embodiments of the present invention may include an interior structural support coupled with an interior surface of the tank. The structural support may be positioned adjacent to the protective housing assembly, in order to provide structural support thereto. The structural support may be provided from one or more plates or from an annular ring positioned inside of the tank.

Other technical advantages are readily apparent to one skilled in the art from the following figures, descriptions, and claims. It should be noted that one or more embodiments disclosed herein may benefit from some, none, or all of the advantages discussed herein.

BRIEF DESCRIPTION OF THE DRAWINGS

A more complete and thorough understanding of the present embodiments and advantages thereof may be acquired by referring to the following description, taken in conjunction with the accompanying drawings, in which like reference numbers indicate like features, and wherein.

DETAILED DESCRIPTION OF THE INVENTION

Tank cars may be used to transport gases or liquids along rail lines. Many tank cars include fittings and/or valves (hereafter collectively referred to as valves) at the top of the tank car to allow introduction of the fluids being transported. The opening at the top of the tank car that allows introduction of the valves is referred to as a manway. The manway may be covered with a protective housing assembly to prevent tampering with or damage to the valves.

When a tank car is involved in a high speed derailment, conventional protective housing assemblies and valve assemblies may be sheared from the remainder of the tank car or otherwise damaged. If the valves are sheared off or severely damaged during a high speed derailment, the contents of the tank car may escape. If the material being transported is a hazardous material, this may cause a hazardous or environmentally damaging condition. Even if the material being transported is not hazardous, an economic loss will be suffered by the owner of the tank car and the owner of the contents of the tank car. Therefore it is desirable to have a sturdy, well supported, protective housing assembly surrounding the manway and valves.

A protective housing assembly may be made more sturdy by using thicker or more rigid components in its construction. For instance, a component that is ordinarily fabricated from one-half inch thick material may be fabricated from one inch thick material. A protective housing may also be made more effective by use of a studding flange in lieu of a manway nozzle, thereby lowering the profile and reducing the vulnerability of the cover plate and associated valves and fittings. Further, a plurality of supports may be coupled between the protective housing assembly and the body of the tank car. Additionally, an external reinforcement plate may surround or be integral to the protective housing assembly such that the external reinforcement stiffens the protective housing. These modifications may result in the valves sustaining reduced damage from a derailment.

Railway tank car capacity may also be increased to add an additional measure of risk reduction. More sturdy and impact resistant tank cars may handle greater loads more safely than current tank cars. Increasing the capacity of tank cars may reduce the number of shipments and thereby decrease the risk of derailment.

Figure 1A:
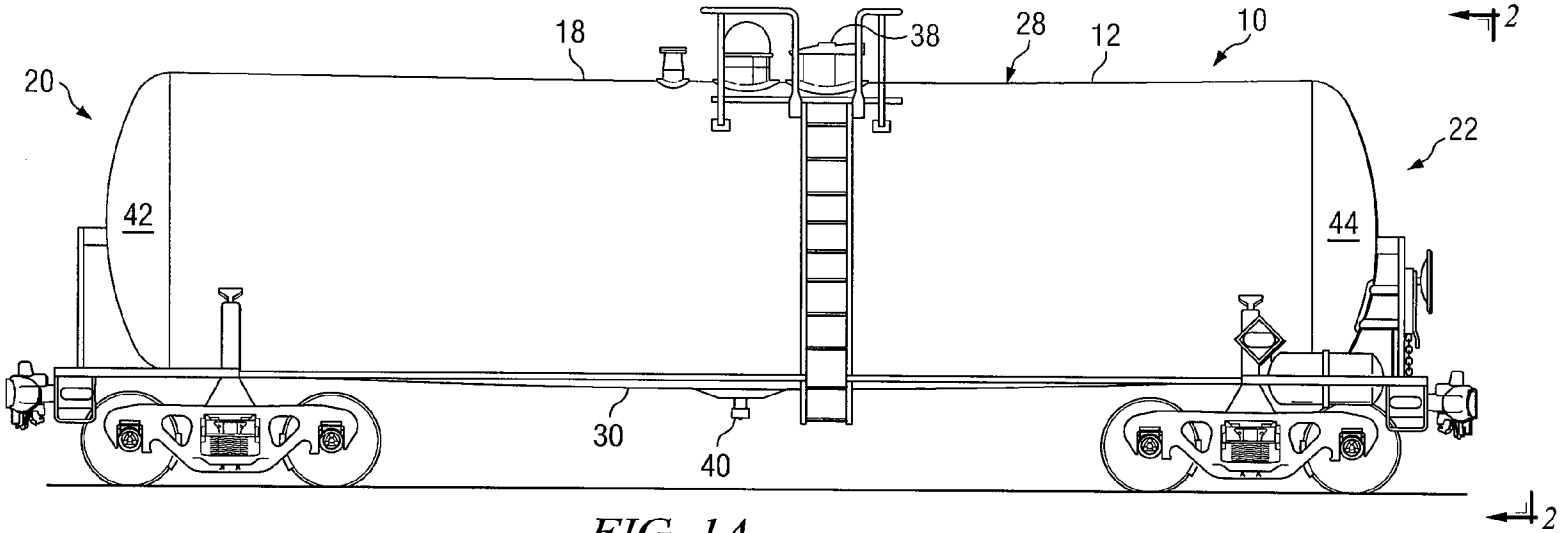
FIG. 1A (PRIOR ART)
FIG. 1A is a schematic drawing illustrating a side view of a railway tank car having a manway with a protective housing assembly formed on an upper portion of the tank car.
Figure 1B:
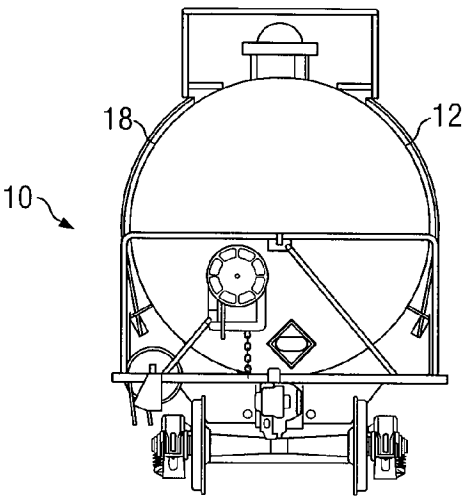
FIG. 1B (PRIOR ART)
FIG. 1B is a schematic drawing illustrating an end view of the railway tank car of FIG. 1.

Referring to FIGS. 1A and 1B, a customary railway tank car 10 includes a tank 12. Tank 12 includes a generally elongated hollow cylinder 18 enclosed at a first end 20 and a second end 22. Tank 12 also includes an upper portion 28 and a lower portion 30.

Tank car 10 may be used to transport a variety of hazardous and non-hazardous liquid or semi-liquid bulk commodities. Fluid commodities may be loaded into tank 12 through a variety of tank fittings such as a manway 38. Unloading of the commodities, or lading, may be accomplished through a variety of fittings, such as a discharge valve 40 or manway 38. In other embodiments, discharge valve 40 and manway 38 may be located virtually anywhere on tank 12, for example, along upper portion 28, lower portion 30, or proximate first end 20 or second end 22 of tank 12. In addition, tank 12 may be pressurized to assist in the unloading of the lading. Further, the shape and/or configuration of tank 12 may assist in unloading the lading. For example, tank 12 may slope gradually at lower portion 30 from each end 20 and 22 toward discharge valve 40. The configuration and slope of upper portion 28 of tank 12 may conform to the configuration and slope of the lower portion 30.

A head 42 is coupled to cylinder 18 at first end 20. Similarly, a head 44 is coupled to cylinder 18 at second end 22. Cylinder 18 and heads 42 and 44 at least partially define tank 12 and protect the contents of tank 12 from the ambient environment.

In particular embodiments of the present invention, the capacity of tank cars may be increased from 90 tons to 96.3 tons or more.

Figure 1C:
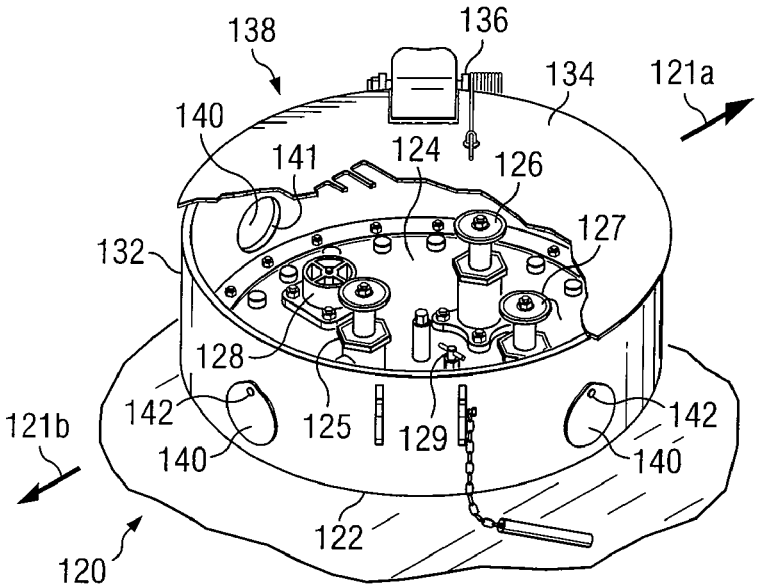
FIG. 1C (PRIOR ART)
FIG. 1C is a schematic drawing in elevation, with portions broken away, showing a conventional protective housing assembly or dome assembly mounted on a tank car surrounding a manway of the tank car, with the protective housing assembly in its first, closed position.

FIG. 1C illustrates portions of a railway tank car 120 with a conventional protective housing assembly 138 mounted thereon. Tank car 120 preferably includes manway or access opening 122 located in an upper portion thereof, proximate a midpoint between opposite ends 121*a* and 121*b* of tank car 120. Protective housing assembly 138 includes a generally hollow, cylindrical portion 132 and normal access cover or lid 134. Hinge assembly 136 allows lid 134 to rotate between a first, closed position, as shown in FIG. 1C, and a second, open position (not expressly shown). Cylindrical portion 132 may sometimes be referred to as a sidewall.

A protective housing assembly formed in accordance with teachings of the present invention may have various configurations and dimensions. The present invention is not limited to use with protective housing assemblies which have a generally hollow cylindrical portion or cylindrical sidewalls. A protective housing assembly having sidewalls with a wide variety of geometric configurations such as square, rectangular, etc. may be formed with structural enhancements in accordance with teachings of the present invention.

The dimensions of cylindrical portion 132 may be selected to accommodate the outside diameter of manway 122 and manway cover 124, to allow cylindrical portion 132 to generally surround the valves on manway cover 124. Various valves and fittings designated 125, 126, 127, 128 and 129 may be mounted on manway cover 124 to control loading and unloading of commodities from tank car 120. Additionally, cylindrical portion 132 may be bolted or otherwise coupled to manway cover plate 124. Protective housing assembly 138 prevents damage to valves and fittings 125 through 129 in the event tank car 120 is derailed and turns over. One of these valves will typically be a safety valve that discharges fluid from tank car 120 when the pressure of fluid contained therein exceeds a predetermined, maximum value.

A vent opening or discharge opening may also be formed in lid 134 to allow any fluids discharged from the safety valve to exit from protective housing assembly 138. The vent opening may also have a respective cover which opens and closes in response to any fluids discharged from the associated safety valve.

A plurality of portholes or openings 141 may be formed in cylindrical portion 132 of protective housing assembly 138. Respective porthole covers 140 may be mounted on the exterior of cylindrical portion 132 adjacent to each porthole 138. For the example shown in FIG. 1C, portholes 141 and porthole covers 140 have generally circular configurations. Pivot pin 142 may be used to rotatably or pivotally mount each porthole cover 140 adjacent to respective porthole opening 141. Porthole covers 140 may be rotated from a first closed position as shown in FIG. 1C to a second, open position (not expressly shown) which allows access to and/or operation of adjacent valves 125 through 129.

Figure 1D:
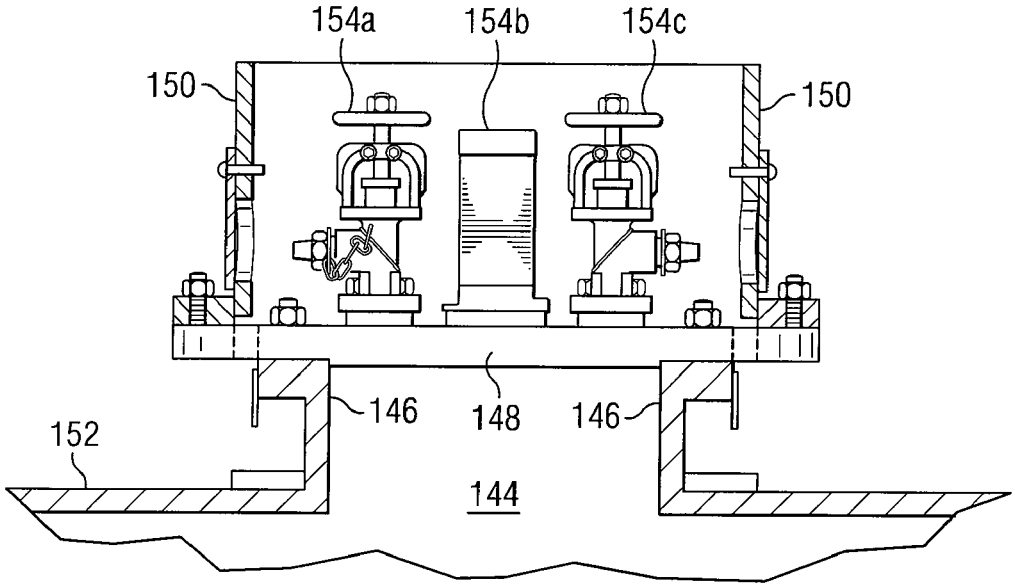
FIG. 1D (PRIOR ART)
FIG. 1D is a cross sectional view, with portions broken away, illustrating a conventional manway nozzle and protective housing.

FIG. 1D illustrates a conventional configuration of a manway 144, manway nozzle 146, manway cover plate 148, and protective housing 150, in more detail. As illustrated in FIG. 1D, manway cover plate 148 is disposed above and spaced from the tank 152 of a railway tank car. Protective housing 150 protects valves 154*a-c* from damage.

Figure 2A:
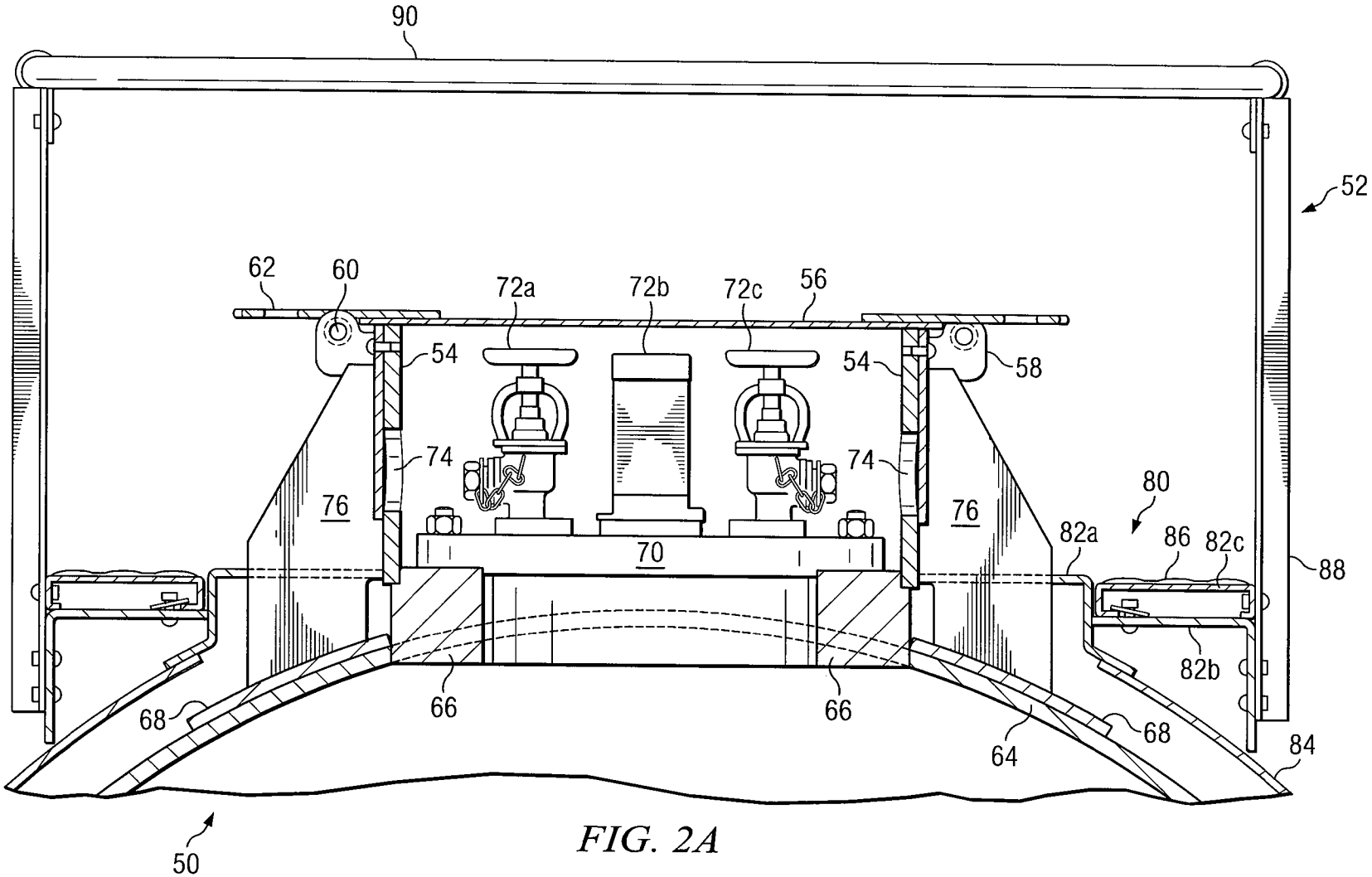
FIG. 2A is an axial cross sectional view, with portions broken away, illustrating a tank car with a protective housing in accordance with a particular embodiment of the present invention.
Figure 2B:
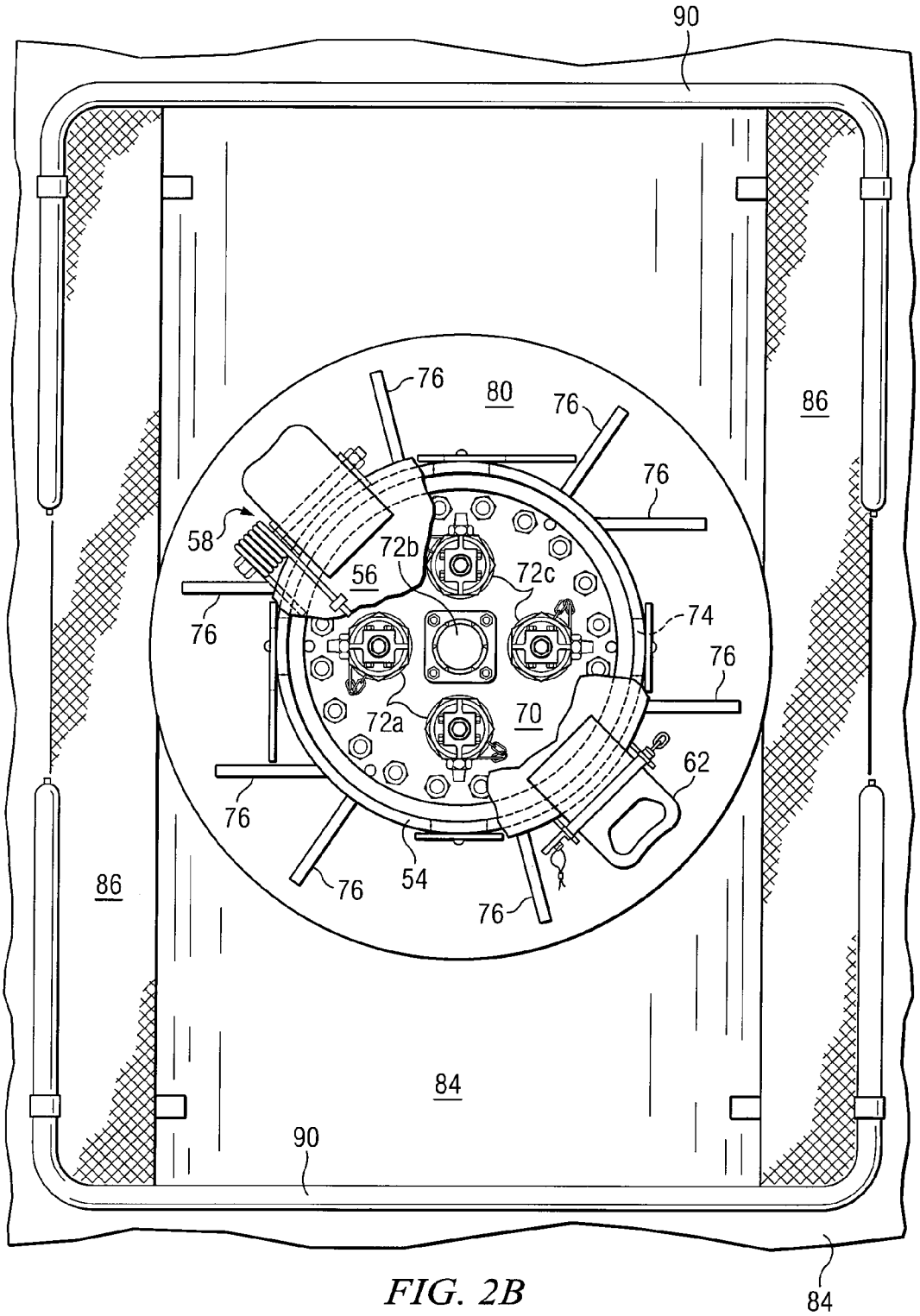
FIG. 2B is a schematic drawing illustrating a top view of the tank car and protective housing of FIG. 2A.
Figure 2C:
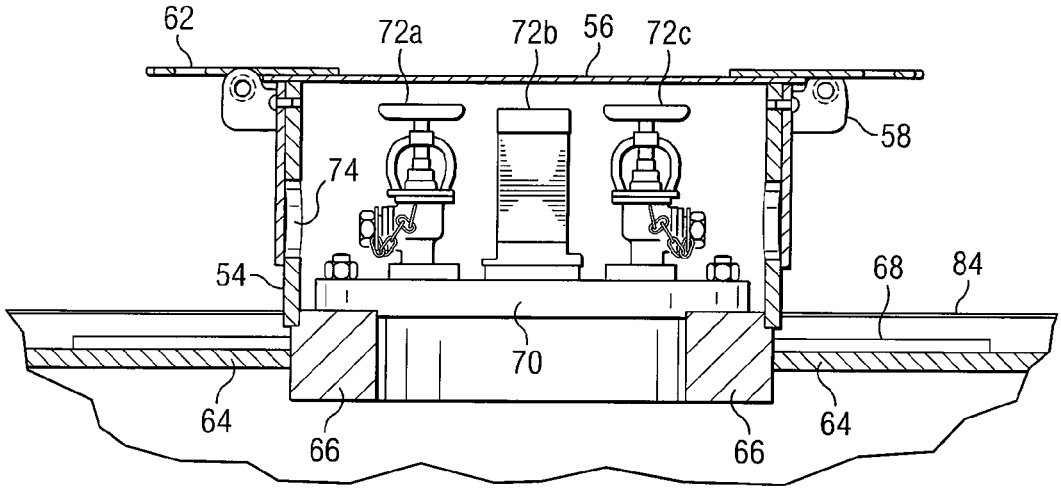
FIG. 2C is a longitudinal cross sectional view, with portions broken away, illustrating the tank car and protective housing of FIG. 2A.

Aspects of the present invention are illustrated and described in conjunction with FIGS. 2A-2C. FIG. 2A is a cross sectional view, with portions broken away, taken axially through a tank car 50, and illustrating a protective housing assembly 52 in accordance with an embodiment of the present invention. FIG. 2B is a schematic drawing, illustrating a top view of the tank car and protective housing of FIG. 2A. FIG. 2C is cross sectional view, with portions broken away, illustrating aspects of the tank car and protective housing of FIG. 2A.

Protective housing assembly 52 includes a cylindrical portion 54, a lid 56, and a hinge assembly 58. A pin may inserted into opening 60 to prevent a third party from lifting up on handle 62 of lid 56 to raise lid 56 and thereby expose the valves housed within protective housing assembly 52. Lid 56 may have provisions for a cable seal and lock to hold it in a shut position relative to cylindrical portion 54.

As illustrated in FIG. 2A, tank car 50 includes a tank 64. The top of tank 64 has a hole cut from it and a manway nozzle or cylindrical studding flange 66 welded into the hole. A manway collar 68 resides around the manway cut from tank 64. Studding flange 66 is coupled to tank 64 and manway collar 68. Studding flange 66 is a metal ring that couples a manway cover plate 70 to tank 64. In particular embodiments, studding flange 66 may be welded to the portion of tank 64 and/or manway collar 68 surrounding the manway, and may include a plurality of threaded holes to accommodate bolts or studs to removably couple manway cover plate 70 to studding flange 66. In this manner manway cover plate 70 may be removed to allow access the interior of tank car 50.

Coupled to manway cover plate 70 are a plurality of valves 72*a-c*. Valves 72*a-c* may allow introduction of a fluid into tank car 50 or may allow removal of a fluid from tank car 50. As discussed above regarding FIG. 1C, one or more of valves 72*a-c* may be a safety valve (e.g., 500 psig start-to-discharge Safety Valve) to prevent excess pressure buildup within tank car 50.

Cylindrical portion 54 of protective housing assembly 52 surrounds the manway cover plate 70 and valves 72*a-c*. Cylindrical portion 54 may be coupled with studding flange 66. The coupling of cylindrical portion 54 with studding flange 66 may occur by welding, bolting, or other appropriate method of fixing cylindrical portion 54 to studding flange 66. In a particular embodiment, cylindrical portion 54 may be fabricated from one inch thick A572 grade 50 steel.

Cylindrical portion 54 may have a plurality of portholes 74 removed from it to allow access to the fittings and/or valves 72*a-c*. The locations of the portholes 74 will correspond to access points on the valves 72*a-c* when the protective housing assembly 52 is installed on the tank car 50.

A plurality of braces, or structural supports 76 may be coupled to the cylindrical portion 54 of protective housing assembly 52 and the body of tank 64 and/or manway collar 68. In the illustrated embodiment, these structural supports are approximately triangular gussets. A gusset may be a triangular member used to strengthen connections between adjacent parts, in this case, cylindrical portion 54 and tank 64. Alternative embodiments may utilize structural supports 76 of practically any shape. A generally vertical leg of the structural supports 76 may be coupled to the cylindrical portion 54 and a generally horizontal leg of structural support 76 may be coupled with the body of tank 64 and/or manway collar 68. In a particular embodiment, structural supports 76 may be coupled to cylindrical portion 54 and the body of tank 64 and/or manway collar 68 by welding. Structural supports 76 provide additional support for cylindrical portion 54 by more securely anchoring it to tank 64.

In a particular embodiment of the present invention, cylindrical portion 54 and structural supports 76 may be fabricated from one inch thick A572 grade 50 steel; and manway collar 68 may be a pad fabricated from three-quarter inch thick A572 grade 50 steel.

Tank car 50 may also include flat work surfaces 80 to allow workers to walk around the top of tank car 50 (e.g., to access the valves 72*a-c*). Work surfaces 80 are generally formed by structural members 82*a*-82*c*. Structural member 82*a* extends generally from cylindrical portion 54 to a jacket 84 of tank car 50. Structural member 82*b* extends outwardly from a leg of structural member 82*a* and generally contacts jacket 84 for additional support. Structural member 82*c* is coupled with structural member 82*b*, and cooperates with a top portion of structural member 82*a* to form the flat work surfaces 80. In the illustrated embodiment, the top portion of structural member 82*c* includes diamond plate 86, to facilitate a safer work surface.

Work surface 80 is generally enclosed by a railing system that includes vertical railings 88 and horizontal railings 90. Vertical railings are coupled with structural members 82*b* and 82*c*, using fasteners. Horizontal railings 90 are coupled with vertical railings 88, also with a plurality of fasteners. Collectively, vertical railings 88 and horizontal railings 90 help to protect workers that are working on flat work surface 80.

Figure 3:
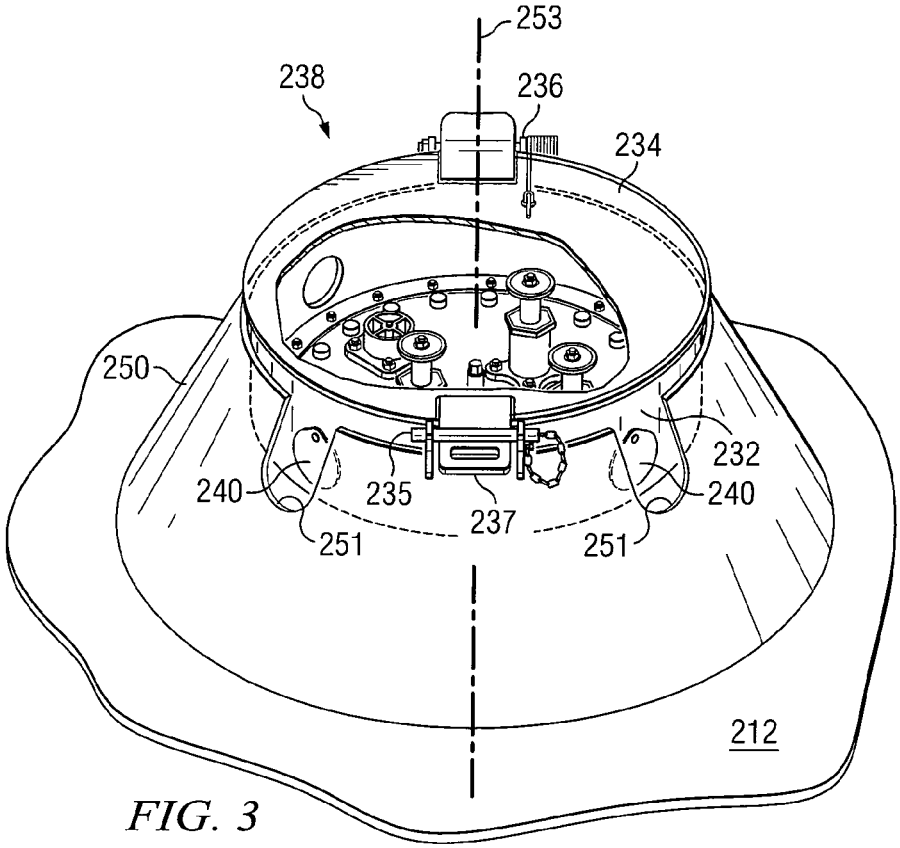
FIG. 3 is a schematic drawing illustrating an isometric view of a protective housing assembly mounted on a tank car surrounding a manway of the tank car, with an external reinforcement coupled to the protective housing assembly in accordance with one embodiment of the present invention.

FIG. 3 illustrates a protective housing assembly 238 in accordance with an embodiment of the present invention. Like protective housing assembly 138, protective housing assembly 238 includes a cylindrical portion 232, a lid 234, and a hinge assembly 236. Pin 235 may be removed allowing a user to lift up on handle 237 of lid 234 to raise lid 234 and thereby expose the valves housed within protective housing assembly 238. Lid 234 may have provision for a cable seal and lock to hold it in a shut position relative to cylindrical portion 232.

An angled external reinforcement 250 is coupled to and disposed around a circumference of protective housing assembly 238. External reinforcement 250 may be coupled to cylindrical portion 232 of protective housing assembly 238 and to tank 212. External reinforcement 250 may add additional support for protective housing assembly 238 by increasing the rigidity of protective housing assembly 238 and by increasing the strength of the coupling of protective housing assembly 238 with tank 212. In particular embodiments, external reinforcement 250 may be welded to cylindrical portion 232 and to tank 212. In other embodiments, external reinforcement 250 may be coupled to protective housing 238 and tank 212 by a plurality of structural supports that couple cylindrical portion 232 and tank 212. In still another embodiment, external reinforcement 250 may be coupled to cylindrical portion 232 and tank 212 by a pour-in-place material. Alternative embodiments may combine one or more of these embodiments as well as any other appropriate method to couple external reinforcement 250 to protective housing 238. Specific details of the above mentioned embodiments will be explained in more detail and illustrated with reference to FIGS. 4-7.

In the event of a derailment, external reinforcement 250 may serve to stiffen the protective housing assembly 238. To this end, external reinforcement 250 may be set at an angle relative to a longitudinal axis 253 of cylindrical portion 232. External reinforcement 250 may be disposed at practically any angle relative to longitudinal axis 253, and in a particular embodiment may be angled at approximately 40 to 50 degrees (e.g., 45 degrees).

In a particular embodiment, external reinforcement 250 may be fabricated from one inch thick A572 grade 50 steel.

Additionally, external reinforcement 250 may include a plurality of cutouts 251 that align with portholes 241 (see FIGS. 4 and 5) in cylindrical portion 232 of protective housing assembly 238. Much like portholes 141 of FIG. 1C, portholes 241 may allow access to the valves housed within protective housing assembly 238. Portholes 241 may be covered by porthole covers 240. Porthole covers 240 may be ordinary pivoting porthole covers, such as those described above with reference to FIG. 1C, or may be any of the porthole covers described in co-pending patent application Ser. No. 10/683,942, which is hereby incorporated by reference. A particular embodiment of the present invention that incorporates secure porthole covers as part of lid 234 will be illustrated and described with reference to FIG. 7.

Figure 4:
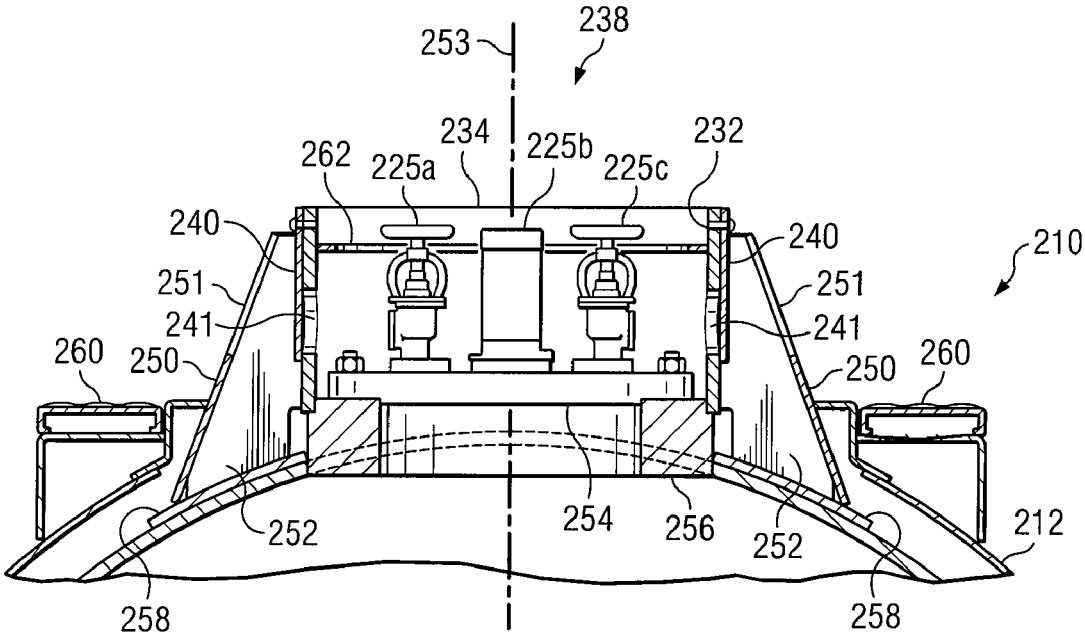
FIG. 4 is a cross sectional view of a tank car with a protective housing assembly coupled to it, and having a plurality of structural supports and an external reinforcement coupled to the protective housing assembly and the tank in accordance with one embodiment of the present invention.

FIG. 4 illustrates a cross-sectional view from an end of tank car 210 through protective housing assembly 238 and tank 212 of tank car 210. The top of tank 212 has a hole cut from it and a studding flange welded into the hole. A manway collar 258 resides around the manway cut from tank 212. A studding flange 256 is coupled to tank 212 and manway collar 258. Studding flange 256 is a metal ring that serves to couple manway cover plate 254 to tank 212. In particular embodiments, studding flange 256 may be welded to the portion of tank 212 and/or manway collar 258 surrounding the manway, and may include a plurality of threaded holes to accommodate bolts or studs to removably couple manway cover plate 254 to studding flange 256. In this manner manway cover plate 254 may be removed to allow access the interior of tank car 210.

Coupled to manway cover plate 254 are a plurality of valves 225*a*-*c*. Valves 225*a*-*c* may allow introduction of a fluid into tank car 210 or may allow removal of a fluid from tank car 210. As discussed above regarding FIG. 1C, one or more of valves 225*a*-*c* may be a safety valve to prevent excess pressure buildup within tank car 210.

Cylindrical portion 232 of protective housing assembly 238 surrounds the manway cover plate 254 and valves 225*a*-*c*. Cylindrical portion 232 may be coupled with studding flange 256. The coupling of cylindrical portion 232 with studding flange 256 may occur by welding, bolting, or other appropriate method of fixing cylindrical portion 232 to studding flange 256. In a particular embodiment, cylindrical portion 232 may be fabricated from one inch thick A572 grade 50 steel.

Cylindrical portion 232 may have a plurality of portholes 241 removed from it to allow access to the fittings and/or valves 225*a*-*c*. The locations of the portholes 241 will correspond to access points on the valves 225*a*-*c* when the protective housing assembly 238 is installed on the tank car 210.

Cylindrical portion 232 may have a stiffening ring 262 coupled to it. Stiffening ring 262 may be a strip of rigid material press fit, bolted, welded, or otherwise coupled to cylindrical portion 232 to add rigidity to cylindrical portion 232. Stiffening ring 262 may be located on the inside or outside of cylindrical portion 232. If it is on the outside, it may be coupled, directly or indirectly, to supports 252 or to external reinforcement 250.

Stiffening ring 262 is only one example of a support which may be used to stiffen cylindrical portion 232 and make it less likely to deform during a derailment. Alternative stiffening members may be of practically any shapes and/or arrangements that add support for cylindrical portion 232 and protective housing assembly 238 without significantly restricting access to valves 225*a*-*c* and manway cover plate 254.

A plurality of structural supports 252 may be coupled to the cylindrical portion 232 of protective housing assembly 238 and the body of tank 212 and/or manway collar 258. In the illustrated embodiment, these structural supports are approximately triangular gussets. A gusset may be a triangular member used to strengthen connections between adjacent parts, in this case, cylindrical portion 232 and tank 212. Alternative embodiments may utilize structural supports 252 of practically any shape. A generally vertical leg of the structural supports 252 may be coupled to the cylindrical portion 232 and a generally horizontal leg of structural support 252 may be coupled with the body of tank 212 and/or manway collar 258. In a particular embodiment, structural supports 252 may be coupled to cylindrical portion 232 and the body of tank 212 and/or manway collar 258 by welding. Structural supports 252 provide additional support for cylindrical portion 232 by more securely anchoring it to tank 212.

Structural supports 252 may be approximately triangularly shaped such that the hypotenuse, or longest legs, of Structural supports 252 are angled with respect to longitudinal axis 253 of protective housing assembly 238. Such a configuration may allow external reinforcement 250 to be flushly coupled with structural supports 252. The angle of the hypotenuse of structural supports 252 may be chosen to provide the desired angle for external reinforcement 250. In a particular embodiment, the hypotenuse of structural supports 252 may be angled at approximately 40 to 50 degrees from the longitudinal axis 253. In alternative embodiments external reinforcement 250 may be modified to correspond to practically any shape or configuration chosen for structural supports 252.

In a particular embodiment, structural supports 252 may be fabricated from one inch thick A572 grade 50 steel.

Tank car 210 may also include walkways 260 to allow workers to walk around the top of tank car 210 to access the valves 225*a-c*.

Figure 5:
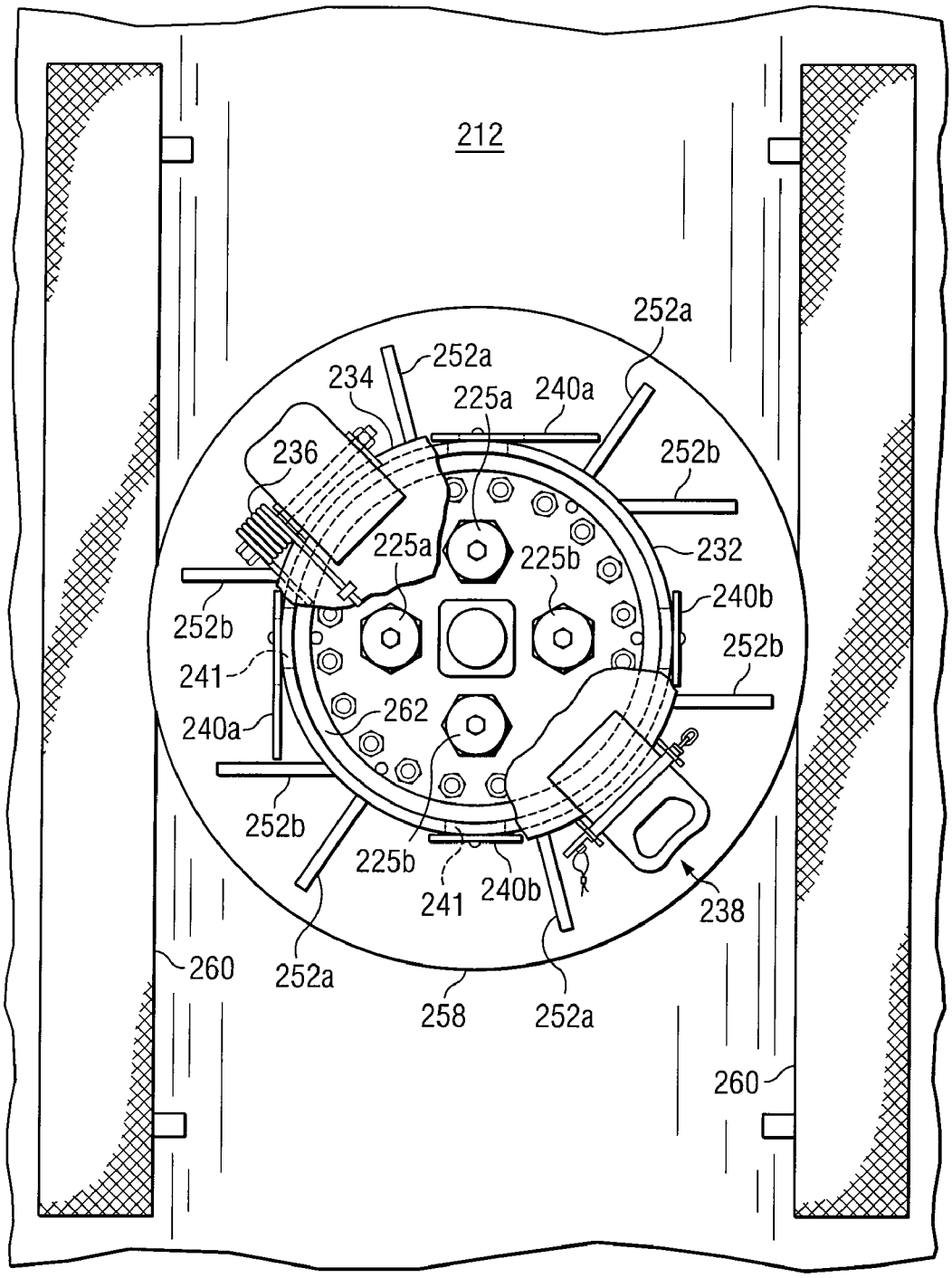
FIG. 5 is a top view of the tank car of FIG. 4, with the tank and external reinforcement removed, illustrating a layout of structural supports around the protective housing assembly in accordance with one embodiment of the present invention.

FIG. 5 illustrates a top view of protective housing assembly 238 with portions broken away, and the surrounding portions of tank car 210. External reinforcement 250 is not illustrated in FIG. 5 to more clearly illustrate structural supports 252*a* and 252*b* (collectively, "structural supports 252"). Various embodiments of the present invention may incorporate one or both or structural supports 252 and external reinforcement 250.

FIG. 5 illustrates eight structural supports 252 arrayed around the cylindrical portion 232 of protective housing assembly 238. Eight structural supports have been shown for illustrative purposes only, and practically any number of structural supports may be arrayed around protective housing assembly 238.

Four of the structural supports 252*a* are illustrated as being disposed generally radially outwards from longitudinal axis 253 around the circumference of cylindrical portion 232. Another four structural supports 252*b* are illustrated as arranged generally perpendicular to walkways 260, that run approximately parallel to a longitudinal axis of the tank 212, around the circumference of cylindrical portion 232. Structural supports 252 will provide maximum support for protective housing assembly 238 when an impact force is incident on an end of structural support 252 facing away from cylindrical portion 232. Arranging structural supports 252 in a variety of orientations relative to longitudinal axis 253 increases the likelihood of providing the maximum support to protective housing assembly 238 during a derailment. In an alternative embodiment, all of the structural supports 252 may be arranged radially outwards from longitudinal axis 253 around the circumference of cylindrical portion 232.

The number and arrangement of structural supports 252 may be chosen based on the anticipated operating weight of railcar 210, the number of structural supports 252 desired to support external reinforcement 250, or any other considerations or combinations of considerations. In alternate embodiments, structural supports 252 may be arranged in any manner and arrangement suitable to properly support protective housing assembly 238.

The structural supports 252 illustrated in FIG. 5 are arranged so as not to interfere with operation of porthole covers 240. Two porthole covers 240*a* are illustrated in an open position, thereby allowing access to valves 225*a* inside protective housing assembly 238, and two porthole covers 240*b* are illustrated in the closed position, thereby restricting access to valves 225*b*.

Figure 6:
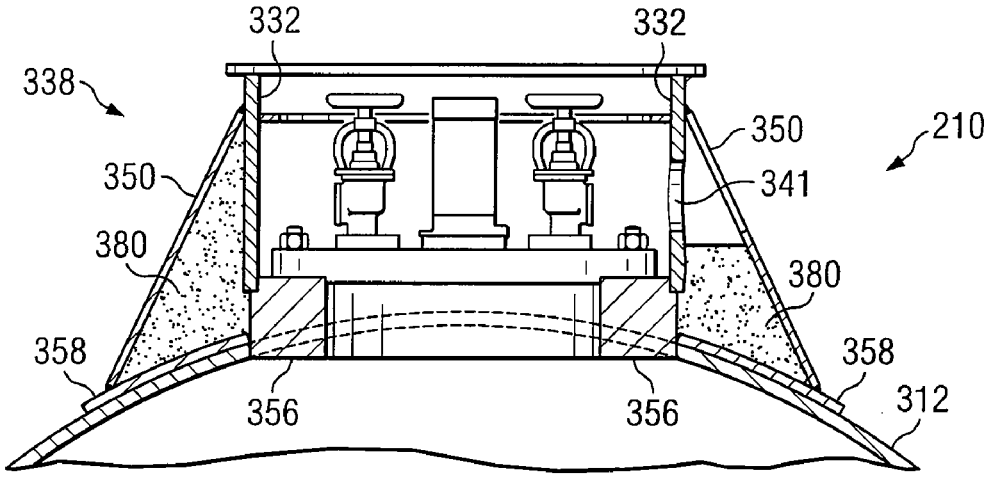
FIG. 6 is a cross sectional view of a tank car with a protective housing assembly coupled to it, and having a stiffening agent disposed within a space formed between an external reinforcement, the protective housing assembly, and the tank in accordance with one embodiment of the present invention.

FIG. 6 illustrates a cross sectional view of a particular embodiment of protective housing assembly 338. Protective housing assembly 338 is similar to protective housing assembly 238 with the addition of a stiffening agent into the area formed by external reinforcement 350, cylindrical portion 332, studding flange 356, manway collar 358, and/or tank 312. In some embodiments the stiffening agent 380 may be an expansive stiffening agent. In a particular embodiment stiffening agent 380 may be pour-in-place concrete. Appropriate precautions may be taken during the introduction of stiffening agent 380 to prevent stiffening agent 380 from blocking portholes 341 in the cylindrical portion 332. The stiffening agent may be introduced into the space formed by the external reinforcement, the cylindrical portion, the studding flange, the manway collar, and/or the tank. The stiffening agent may reduce the deformation of the external reinforcement during an impact.

Figure 7:
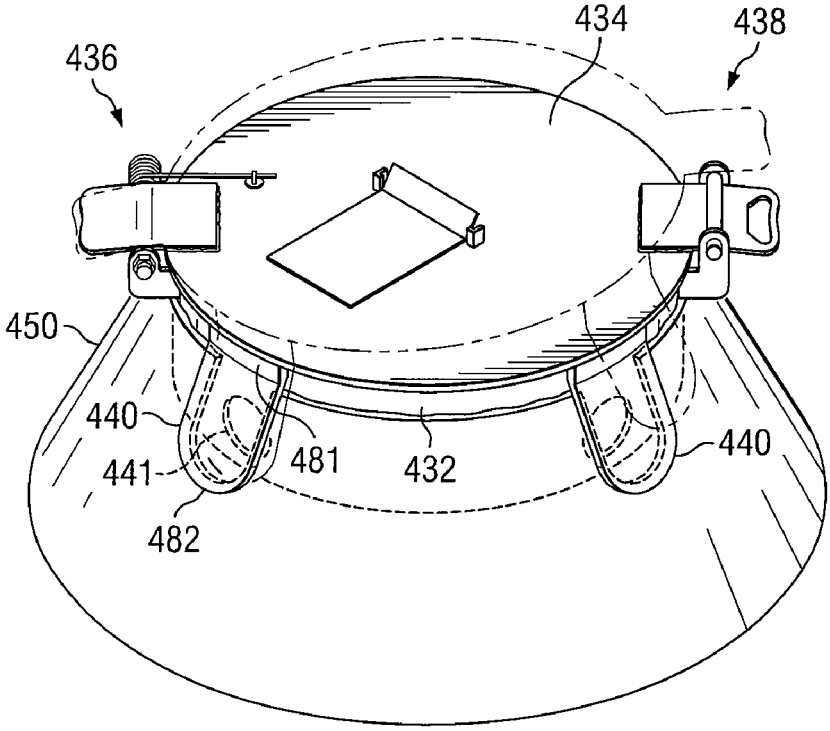
FIG. 7 is a schematic drawing illustrating an isometric view of an alternative embodiment of a protective housing assembly including anti-tampering devices and formed in accordance with the teachings of the present invention, in its first, closed position (dotted lines illustrated partially open position).

FIG. 7 illustrates an alternative embodiment of the present invention as represented by protective housing assembly 438. Protective housing assembly 438 may include cylindrical portion 432, lid 434, hinge assembly 436, and external reinforcement 450 having approximately the same overall dimensions and general configurations as similar components previously described. In FIG. 7, lid 434 is shown in its first, closed position (solid lines) and a second, partially open position (dotted lines). Cylindrical portion 432 of protective housing assembly 438 may also include portholes 441 (shown in dotted lines) having approximately the same dimensions and configuration as previously described. Cutouts from external reinforcement 450 aligning with portholes 441 are also illustrated with dotted lines.

For the embodiment of the present invention as shown in FIG. 7, respective porthole covers 440 may be formed as integral components of lid 434 and may be bent to an angle corresponding to an angle of external reinforcement 450. In a particular embodiment, porthole covers 440 may be bent to approximately 40 to 50 degrees relative to a longitudinal axis of cylindrical portion 432.

Figure 8:
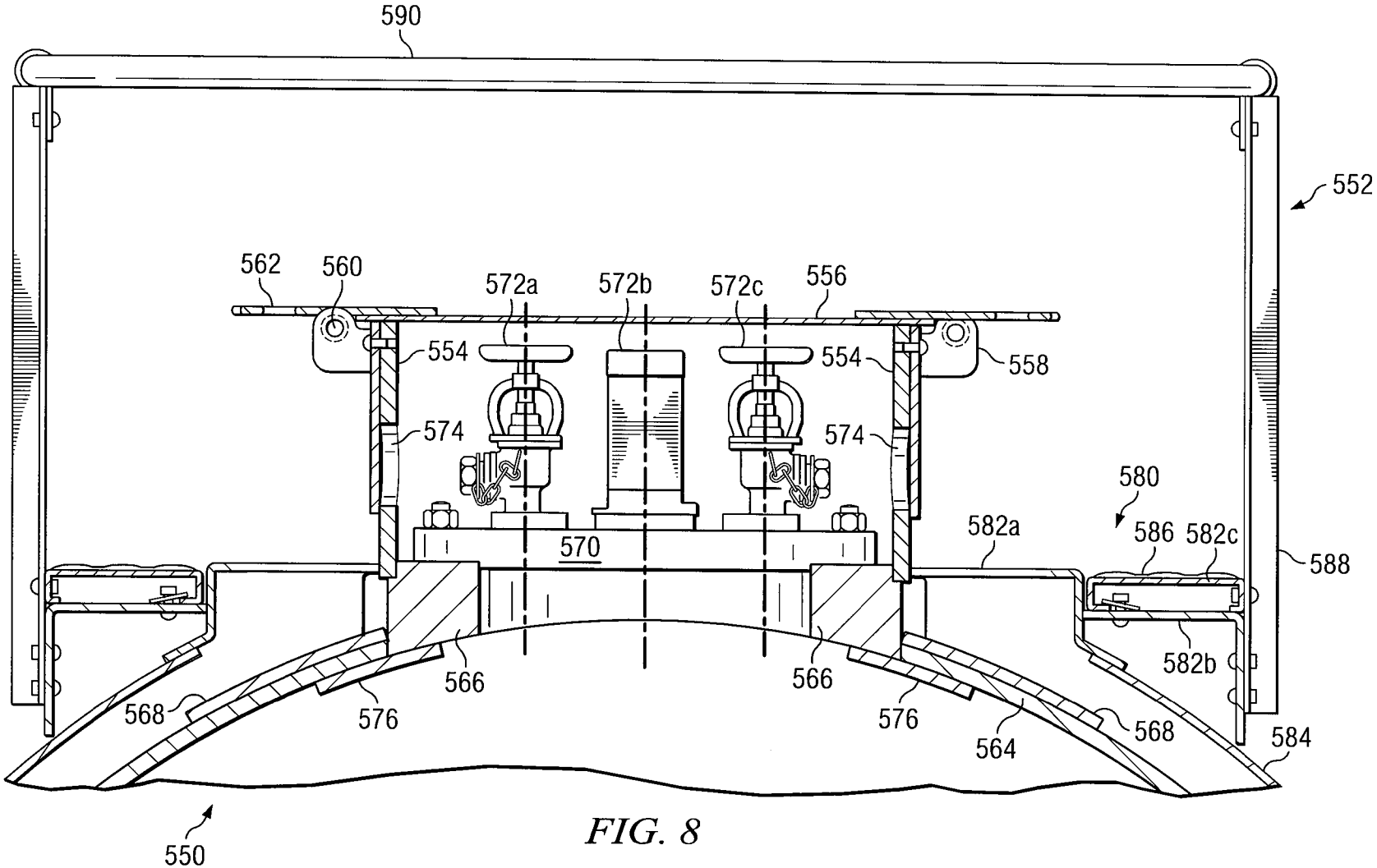
FIG. 8 is an axial cross sectional view, with portions broken away, illustrating a tank car with a structural support for a protective housing in accordance with another embodiment of the present invention.

As illustrated in FIG. 8, tank car 550 includes a tank 564. The top of tank 564 has a hole cut from it and a manway nozzle or cylindrical studding flange 566 welded into the hole. A manway collar 568 resides around the manway cut from tank 564. Studding flange 566 is coupled to tank 564 and manway collar 568. Studding flange 566 is a metal ring that couples a manway cover plate 570 to tank 564. Studding flange 566 may also be contoured along the bottom so that it may be generally flush with the inside surface of the body of the tank 564. In particular embodiments, studding flange 566 may be welded to the portion of tank 564 and/or manway collar 568 surrounding the manway, and may include a plurality of threaded holes to accommodate bolts or studs to removably couple manway cover plate 570 to studding flange 566. In this manner manway cover plate 570 may be removed to allow access to the interior of tank car 550.

Coupled to manway cover plate 570 are a plurality of valves 572*a-c*. Valves 572*a-c* may allow introduction of a fluid into tank car 550 or may allow removal of a fluid from tank car 550. As discussed above regarding FIG. 1C, one or more of valves 572*a-c* may be a safety valve (e.g., 500 psig start-to-discharge Safety Valve) to prevent excess pressure buildup within tank car 550.

Cylindrical portion 554 of protective housing assembly 552 surrounds the manway cover plate 570 and valves 572*a-c*. Cylindrical portion 554 may be coupled with studding flange 566. The coupling of cylindrical portion 554 with studding flange 566 may occur by welding, bolting, or other appropriate method of fixing cylindrical portion 554 to studding flange 566. In a particular embodiment, cylindrical portion 554 may be fabricated from one inch thick A572 grade 50 steel.

Cylindrical portion 554 may have a plurality of portholes 574 removed from it to allow access to the fittings and/or valves 572*a-c*. The locations of the portholes 574 will correspond to access points on the valves 572*a-c* when the protective housing assembly 552 is installed on the tank car 550.

A structural plate, e.g., steel plate 576 may be coupled to the inside of the body of the tank 564 and/or studding flange 566 to provide structural support for the protective housing assembly 552. The steel plate 576 may be positioned adjacent to the cylindrical portion 554 of the protective housing assembly 552. The steel plate 576 may be generally rectangular in shape having dimensions of at least eight inches wide by at least two feet long. Steel plate 576 may also be formed to a radius (e.g., fifty-three inches) to allow it to follow the contour of the inside surface of tank 564. Each of the four corners of steel plate 576 may be rounded to a radius (e.g., one inch radius). In a particular embodiment, steel plate 576 may be fabricated from three-quarter inch thick A572 grade 50 steel.

The steel plate 576 may be welded to the inside of the body of the tank 564 such that a longitudinal axis of the steel plate 576 (e.g., an axis extending along the long dimension of steel plate 576 along the center of the short dimension) is parallel to the longitudinal axis of the tank 564. A second steel plate 576 may be coupled to the body of tank 564 and located parallel to the first steel plate and also positioned adjacent the cylindrical portion 554 of the protective housing assembly 552.

Tank car 550 may also include flat work surfaces 580 to allow workers to walk around the top of tank car 550 (e.g., to access the valves 572*a-c*). Work surfaces 580 are generally formed by structural members 582*a*-582*c*. Structural member 582*a* extends generally from cylindrical portion 554 to a jacket 584 of tank car 550. Structural member 582*b* extends outwardly from a leg of structural member 582*a* and generally contacts jacket 584 for additional support. Structural member 582*c* is coupled with structural member 582*b*, and cooperates with a top portion of structural member 582*a* to form the flat work surfaces 580. In the illustrated embodiment, the top portion of structural member 582*c* includes diamond plate 586, to facilitate a safer work surface.

Work surface 580 is generally enclosed by a railing system that includes vertical railings 588 and horizontal railings 590. Vertical railings are coupled with structural members 582*b* and 582*c*, using fasteners. Horizontal railings 590 are coupled with vertical railings 588, also with a plurality of fasteners. Collectively, vertical railings 588 and horizontal railings 590 help to protect workers that are working on flat work surface 580.

Figure 8A:
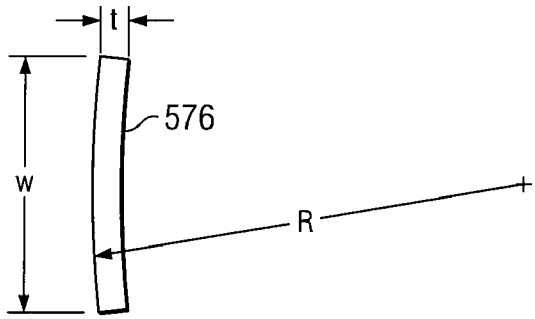
FIG. 8A is an end view of a steel plate that provides structural support for a protective housing assembly in accordance with one embodiment of the present invention.
Figure 8B:
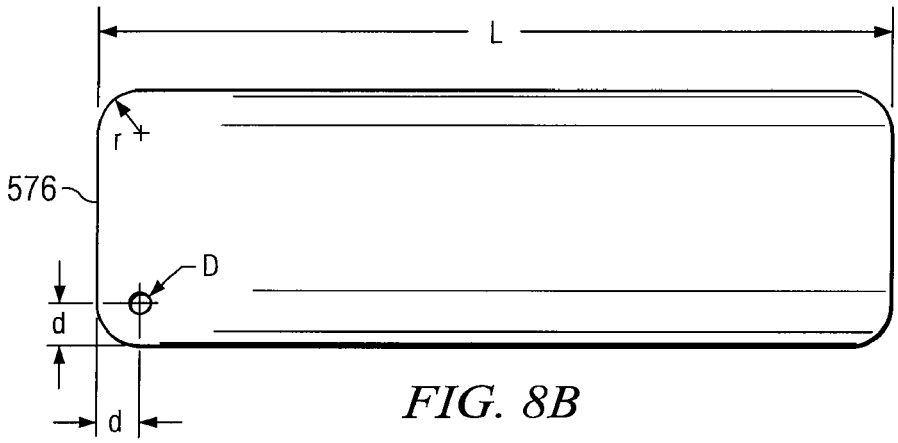
FIG. 8B is a top view of the steel plate of FIG. 8A.
Figure 8C:
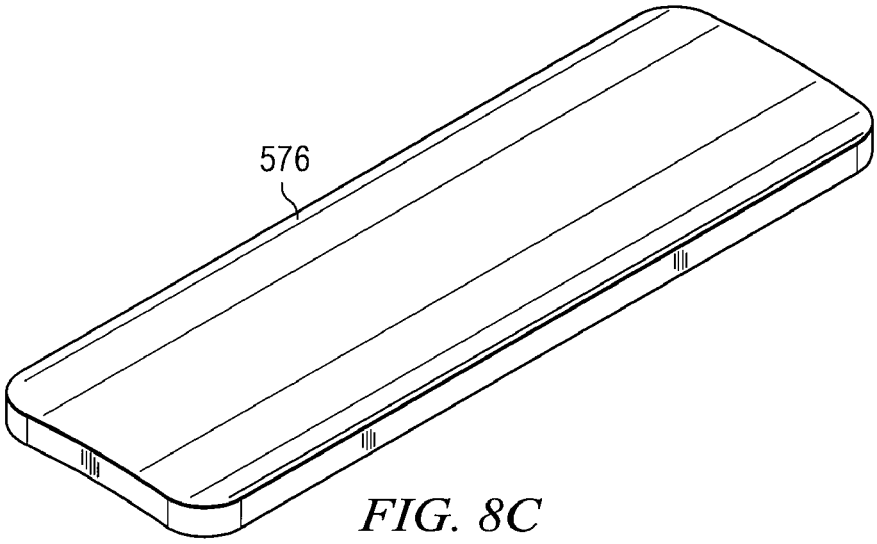
FIG. 8C is an isometric view of the steel plate of FIGS. 8A and 8B.

FIGS. 8A-8C illustrate steel plate 576 in more detail, in accordance with a particular embodiment of the present invention. FIG. 8A illustrates steel plate 576 including a radius R that allows the steel plate to conform to the contour of the interior of the tank. Steel plate 576 also includes a thickness t and a width w. In accordance with one embodiment of the present invention, width w may be approximately equal to eight inches and thickness t may be approximately equal to three-quarters of and inch.

FIG. 8B illustrates rounded corners of steel plate 576 having a radius r. Steel plate 576 has an overall length L. A hole located a distance d from the sides of steel plate 576 and having a diameter D is also illustrated in FIG. 8B. In accordance with a particular embodiment of the present invention, radius r may be approximately equal to one inch, length L may be approximately equal to two feet-four inches, diameter D may be approximately equal to one-quarter inch, and distance d may be approximately equal to one inch.

Figure 8D:
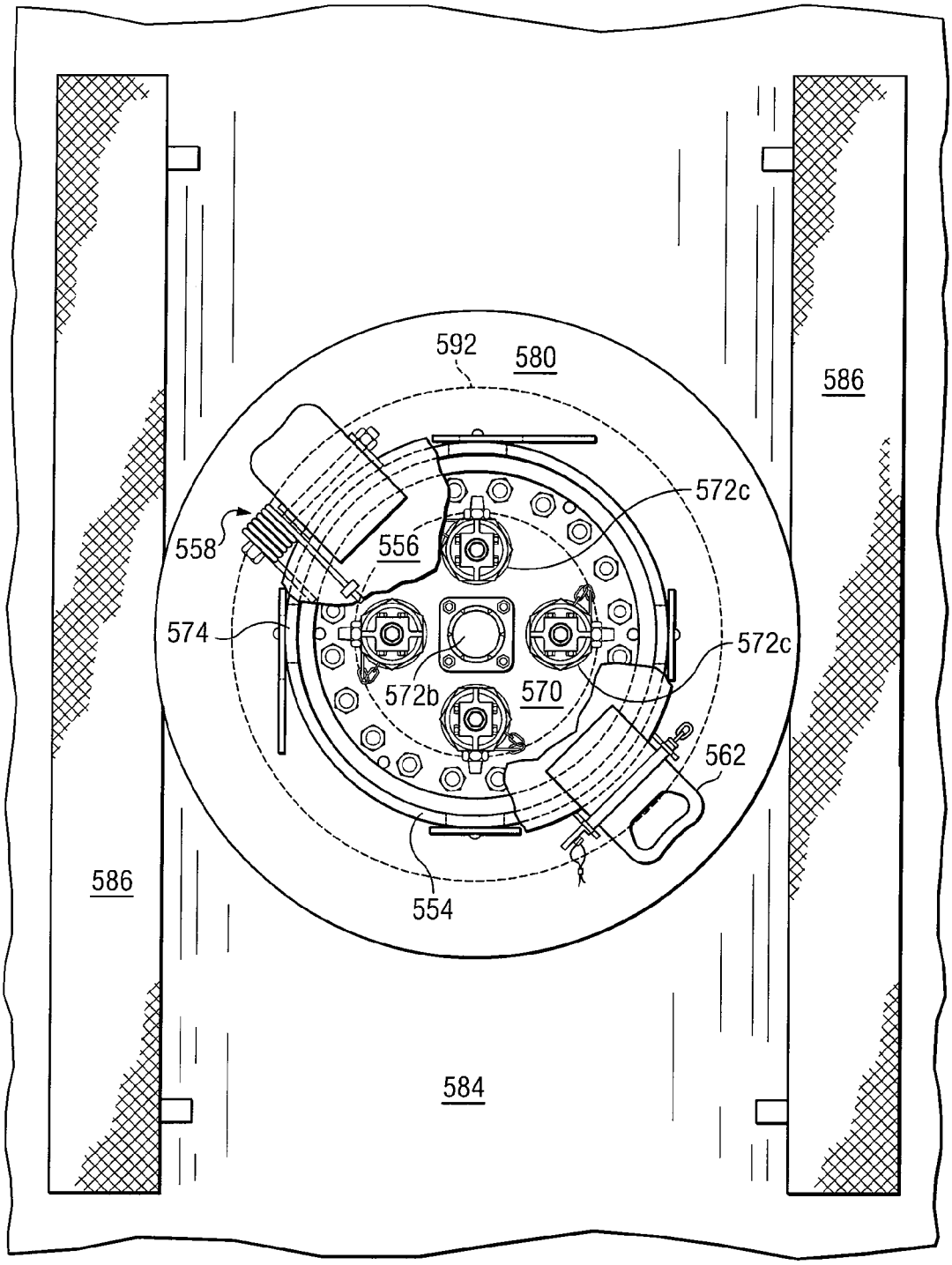
FIG. 8D is a top view of a tank car and a protective housing assembly illustrating an annular ring support that provides structural support for the protective housing assembly in accordance with one embodiment of the present invention.

FIG. 8D illustrates an alternative embodiment of the present invention. In this embodiment, a structural support for the protective housing assembly 552 is provided by an annular ring support 592, in lieu of one or more rectangular plates. The annular ring support may be welded to the inside of tank car 550 and/or studding flange 566. Annular ring support 592 may be positioned such that a circular mid-line of the annular ring support 592 aligns with the cylindrical portion 554 of the protective housing assembly 552.

As illustrated in FIG. 8, interior supports may be used in lieu of (or in addition to) exterior structural supports (e.g., triangular gussets). Where interior supports are used in lieu of exterior supports, the amount of welding that may be required to couple the structural supports to the protective housing assembly and to the tank car may be reduced. In addition, the elimination of the exterior welded structural supports eliminates the corresponding flashing that may be required around such welds. Because the structural support may be provided by a steel plate coupled to the inside surface of the body of the tank car, the appearance of the outside of the tank car may be improved aesthetically.

For some applications, first ends 481 of each porthole cover 440 may be coupled with the edge of lid 434. For other applications, porthole covers 440 may be formed from the same sheet of material which is used to form lid 434.

The length of each porthole cover 440 from first end 481 to second end 482 may be approximately equal to the height of cylindrical portion 432. The width of porthole covers 440 may vary from first end 481 to second end 482. For example, in the illustrated embodiment, porthole cover 440 is wider proximate lid 434 and tapers to a thinner portion at a lower end 482.

When lid 434 is in its first, closed position, a portion of each porthole cover 440 will extend over and block access through respective portholes 441. When lid 434 is in its second, open position porthole covers 440 will be in their second position, which allows access through respective portholes 441.

In accordance with a particular embodiment of the present invention, the tank car may be manufactured according to the specification DOT 105J600W in lieu of a standard 105J500W. This may result in a tank that is approximately 25% thicker and substantially more puncture resistant than a standard rail car. The rail car may include ½" thick head shields in lieu of standard 11 gauge jacket heads.

For some applications, protective housing assembly 438 may have four portholes 441 formed therein and four porthole covers 440. However, a protective housing assembly may be formed in accordance with teachings of the present invention having any number of portholes and porthole covers.

Some of all of the materials used to fabricate the body of the tank car, the cylindrical portion and lid of the protective housing assembly, the structural supports, and the external reinforcement may be tested to meet certain minimum criteria. For example, various components may be impact-qualified at −50 degrees Fahrenheit.

Various materials may be used to form the various components of the protective housing assemblies described herein. For example, various metals, plastics, composites and/or metal alloys may be used. The particular material selected may be based upon the type of material carried in the associated tank. Furthermore, the specific type of material may be recommended or required by various governing bodies that control the transportation of materials carried in the tank, for example the Association of American Railroads, the U.S. Department of Transportation, or Transport Canada.

A specification for the construction of a tank car that incorporates aspects of the present invention is included below.

This specification is included as an example of the type of car that may benefit from the teachings of the present invention. In no way is the specification below intended to limit the scope or potential application of the teachings of the present invention.

| Capacities | |
|---|---|
| Shell Capacity | 18,063 Gal |
| Outage | 5% |
| Effective Capacity | 192,600 lb (96.3 tons) Chlorine |
| Allowable Weight/Gal. | N/A |
| Clearance Diagram | Plate B |
| Sized For | Chlorine |
| Tank Specification | DOT105A600W |
| Stenciled Specification | DOT105J600W |
| Est. Light weight | 93,400 lb |
| Maximum Gross Weight | 286,000 lb. (See Note 1) |
| Car Dimensions | |
| Tank | 106" I.D. × 36'-5½" Tangent To Tangent |
| Length OCPF | 46'-11½" |
| Slope | Straight Cylinder |
| Head Material & Thickness | 1.136" thk. ASTM A516 Normalized (See Note 4) |
| Shell Material & Thickness | 0.981" thk. AAR TC128 Normalized (See Note 4) |
| Truck Centers | 33'-5" |
| Top Fittings | |
| Manway | 20" I.D. Bolting Flange |
| Air/Vapor Connection | Two 1" Flanged × Screwed Midland A713 Angle Valves w/1" CS Plugs And PTFE/Viton Seats & Seals |
| Discharge Connection | Two 1" Flanged × Screwed Midland A713 Angle Valves w/1" CS Plugs And PTFE/Viton Seats & Seals |
| Gage Device | None |
| Safety Relief | Valve, 500#, Midland A-14502-ML |
| Sample Line | None |
| Sample Line | None |
| Manway Cover | Bolted ASTM A516 Gr. 70 Normalized |
| Protective Housing | 1" thk. ASTM A572 Grade 50 (See Note 5 & 6) |
| Discharge Pipe | Two 1¼" Sch. 80 CS Pipes w/Midland A127 Check Valves |
| Outage Scale | None |
| Vacuum Relief | None |
| Thermowell | None |
| Bottom Fittings | |
| Outlet Valve | None |
| Outlet Nozzle | None |
| Outlet Saddle | None |
| Sump | None |
| Gasket's/O'Rings | |
| Manway Cover | Teadit NA-1001 |
| Fittings Nozzle | None |
| Air/Discharge | Teadit NA-1001 |
| Gage Device | None |
| Safety Relief Gasket/O'Ring | Teadit NA-1001/None |
| Outlet Valve | None |
| Outlet Fittings | None |
| Thermowell | None |
| Coils | |
| Size, Type, No. of Lines | None |
| Inlets/Outlets | None |
| Insulation & Jacket | |
| Insulation Type | 2" Fiberglass Over 2" Ceramic Fiber |
| Jacket Head/Shell | ½" Thk ASTM A572/11 Gage Carbon Steel |
| Platforms | |

-continued

| | |
|---|---|
| Top | Divided Type w/11½" Wide × 8' Long CS Plank Grating with Flat Working Surface & Side Ladders (Anti-Skid Applied To Jacket Between Grating) |
| End | Single 11½" Wide × Full Width Long CS Plank Grating |
| Underframe | |
| Type & Section | Type 23 Stub Sill |
| Brakes | Body Mounted w/10 × 12 Cyl. And Vertical Wheel Handbrake |
| Center Plate | 16" Forged |
| Draft Gear | M-901-E |
| Couplers/Yokes | SE60EE/SY40AE |
| Empty Load Brakes | Yes |
| Trucks | |
| Capacity/Type | ASF Motion Control w/Split Wedges & bolted-only Column Wear Plates |
| Springs | 3 11/16" Travel D-5 |
| Side Bearings | Stucki CCB4500XT Constant Contact |
| Wheels/Bearings | 36" 1 Wear Class C Wheels 6½ × 9 Roller Bearings |
| Roller Bearing Adapters | Pennsy Adapter Plus w/Hardened Shoulders |
| Brake Beams | #18 Unit Type Surface Prep |
| Interior | Sweep Clean |
| Paint, Stencil, Lining | |
| Paint | Black Direct To Metal Epoxy |
| Stencil | AAR/DOT Vinyl Decals |
| Lining | None |

Notes

1. Cars are constructed in accordance with applicable AAR and DOT requirements, including S-286-2002 for 286,000 lb. gross rail load and applicable DOT exemptions. Some rail lines have weight restrictions that could limit use of these cars. DOT tank cars with gross weight over 263,000 lb. require an exemption.
2. Cars are equipped with resilient wear liner package (horizontal bowl liner, coupler carrier wear plate, and brake beam guides)
3. Cars are equipped with two brass grounding studs on diagonally opposite corners of top platform.
4. Tank steel is impact-qualified at −50 degrees F.
5. Protective housing is 1" thk. A572 Grade 50 steel and is welded directly to the bolting flange and braced by four 1" thick gussets.

Alternates

1. Cars are equipped with permanent placard decals in lieu of placard holders.

Numerous other changes, substitutions, variations, alterations and modifications may be ascertained by those skilled in the art and it is intended that the present invention encompass all such changes, substitutions, variations, alterations and modifications as falling within the spirit and scope of the appended claims. Moreover, the present invention is not intended to be limited in any way by any statement in the specification that is not otherwise reflected in the claims.

What is claimed is:

1. A railway tank car having a manway formed in a body of the tank car, the tank car comprising:

a manway cover plate coupled to a body of a tank car and disposed over at least a portion of a manway of the tank car;

a protective housing assembly coupled to the body of the tank car and disposed around the manway cover plate;

at least one structural support coupled with an interior surface of the body of the tank car adjacent to the protective housing assembly, wherein the at least one structural support comprises a first structural plate; and a second structural plate being adjacent to the protective housing assembly and extending generally parallel to the first structural plate, wherein respective longitudinal axes of the first and second structural plates extend generally parallel to a longitudinal axis of the tank car.

2. The railway tank car of claim 1, wherein the at least one structural support comprises a generally rectangular plate.

3. The railway tank car of claim 1, wherein the first and second structural plates include rounded corners and are each at least approximately two feet long and at least approximately eight inches wide.

4. The railway tank car of claim 1, wherein the at least one structural support is fabricated from steel having a thickness of at least approximately three quarters of an inch.

5. The railway tank car of claim 1, wherein the at least one structural support is fabricated from A572 grade 50 steel.

6. The railway tank car of claim 1, wherein the at least one structural support comprises at least one interior structural support, and further comprising:

a plurality of exterior structural supports arranged around an outer perimeter of the protective housing assembly; and the plurality of exterior structural supports being anchored to the protective housing assembly and anchored to an exterior surface of the body of the tank car.

7. The railway tank car of claim 1, wherein the at least one structural plate is welded to the inside of the tank car.

8. The railway tank car of claim 7, wherein a cylindrical portion of the protective housing assembly is fabricated from metal having a thickness of at least one inch.

9. The railway tank car of claim 1, further comprising:

a studding flange coupling the protective housing assembly to the body of the tank car; and the at least one structural support being coupled to the studding flange.

10. The railway tank car of claim 1, further comprising:

a plurality of exterior structural supports arranged around an outer perimeter of the protective housing assembly;

the plurality of exterior structural supports being anchored to the protective housing assembly and anchored to an exterior surface of the body of the tank car;

a studding flange coupling the protective housing assembly to the body of the tank car; and the at least one structural support being coupled to the studding flange.

11. A railway tank car having a manway formed in a body of the tank car, the tank car comprising:

a manway cover plate coupled to a body of a tank car and disposed over at least a portion of a manway of the tank car;

a protective housing assembly coupled to the body of the tank car and disposed around the manway cover plate;

at least one structural support coupled with an interior surface of the body of the tank car adjacent to the protective housing assembly, wherein the at least one structural support comprises a first structural plate;

a second structural plate being adjacent to the protective housing assembly and extending generally parallel to the first structural plate, wherein respective longitudinal axes of the first and second structural plates extend generally parallel to a longitudinal axis of the tank car;

a plurality of exterior structural supports arranged around an outer perimeter of the protective housing assembly;

the plurality of exterior structural supports being coupled to the protective housing assembly and to the body of the tank car;

a studding flange coupling the protective housing assembly to the body of the tank car; and the at least one structural support being coupled to the studding flange.

* * * * *